United States Patent [19]

Jensen

[11] Patent Number: 4,736,532

[45] Date of Patent: Apr. 12, 1988

[54] EXCAVATION APPARATUS

[76] Inventor: John W. Jensen, 155 Oakside Circle SW., Calgary, Alberta, Canada, T2V 4H3

[21] Appl. No.: 890,211

[22] Filed: Jul. 28, 1986

[51] Int. Cl.[4] ..... E02F 7/00

[52] U.S. Cl. ..... 37/8; 280/490 R

[58] Field of Search ..... 37/7-8, 37/124, 126 R, 129; 280/476 R, 490 R

[56] References Cited

U.S. PATENT DOCUMENTS

| | | | |
|---|---|---|---|
| 3,063,740 | 11/1962 | Hancock | 37/88 |
| 3,507,060 | 4/1970 | Gee et al. | 37/8 X |
| 3,670,822 | 6/1972 | Reinhardt | 280/405 |
| 3,814,271 | 6/1974 | Loock | 37/8 X |
| 4,023,285 | 5/1977 | Hancock et al. | 37/8 |

*Primary Examiner*—E. H. Eickholt

*Attorney, Agent, or Firm*—Harold H. Dutton, Jr.; George H. Dunsmuir

[57] ABSTRACT

An excavator for continuously excavating soil includes an elongated frame, which is generally rectangular in plan, the frame being defined by a pair of spaced apart, parallel sides; a tow bar at the front end of the frame for connecting the latter to a tractor or other towing vehicle; a large, central wheel for carrying the frame; hydraulic cylinders for adjusting the height and longitudinal position of the wheel in the frame, and consequently for adjusting the depth of cut made by a blade mounted in the frame behind and/or beneath the wheel and a conveyor mounted in the frame rearwardly of the blade for receiving excavated soil and feeding the soil rearwardly for discharge from the excavator.

13 Claims, 4 Drawing Sheets

EXCAVATION APPARATUS

BACKGROUND OF THE INVENTION

This invention relates to a soil excavator, and in particular to a machine for the continuous excavation of soil.

In this case, the term "soil" should be given a broad interpretation, and is intended to include, inter alia, tar sands.

In general, the excavation of large quantities of soil in mining or large construction jobs is performed using bulldozers, drag lines, bucket wheels, bucket loaders, scraper carriers, etc., alone or in combination. Such machines have various drawbacks, which result in high unit costs to excavate and transfer material. Many currently available machines are used in load, carry or lift, and unload and return cycles. Thus, much of the operating time of the machines involves returning from the unloading or delivery mode to the excavation mode. Many commonly used machines for big volume projects are large, complex and expensive. The machines may also be limited in terms of mobility and portability. Finally, some machines require considerable skill to operate. All of these factors contribute to high operating costs.

OBJECTS OF THE INVENTION

The object of the present invention is to overcome the drawbacks mentioned above by providing a relatively simple, portable excavator, which can excavate soil quickly and continuously, and deliver the material to a carrier for transporting. Moreover, the invention provides an excavator which can be pulled by any of several standard tractors.

SUMMARY OF THE INVENTION

Accordingly, the invention relates to a soil excavator comprising elongated first frame means, said first frame means including a pair of spaced apart sides; tow bar means at the front end of said first frame means for connecting the excavator to a towing vehicle; inclined blade means mounted between said sides in close proximity to the rear end of the first frame means for penetrating the ground and directing soil upwardly and rearwardly; conveyor means rearwardly of said blade means for discharging excavated soil from the excavator; wheel means rotatably mounted between said sides above said blade means for carrying the first frame means; and support means carrying said wheel means pivotally mounted in said first frame means, whereby the wheel means can be moved longitudinally and vertically in said first frame means for adjusting the depth of cut by said blade means.

BRIEF DESCRIPTION OF THE DRAWINGS

The invention will now be described in greater detail with reference to the accompanying drawings, which illustrate a preferred embodiment of the invention, and wherein.

DESCRIPTION OF THE PREFERRED EMBODIMENTS

Figure 1:
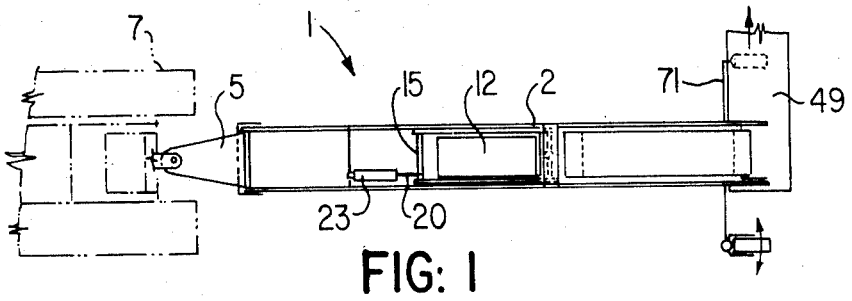
FIG. 1 is a schematic plan view of a soil excavator in accordance with the present invention.
Figure 2:
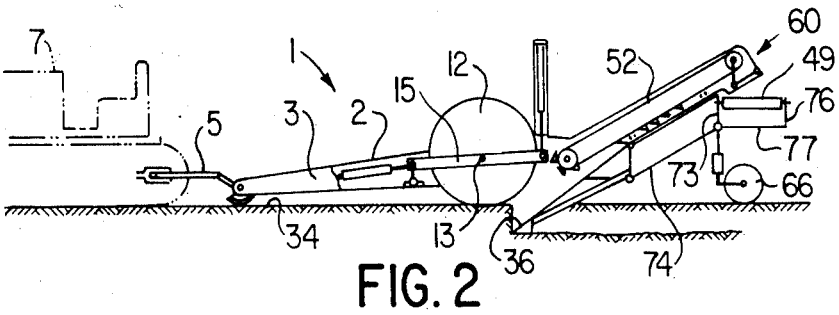
FIG. 2 is a schematic partly sectioned, side elevation view of the excavator of FIG. 1.
Figure 3:
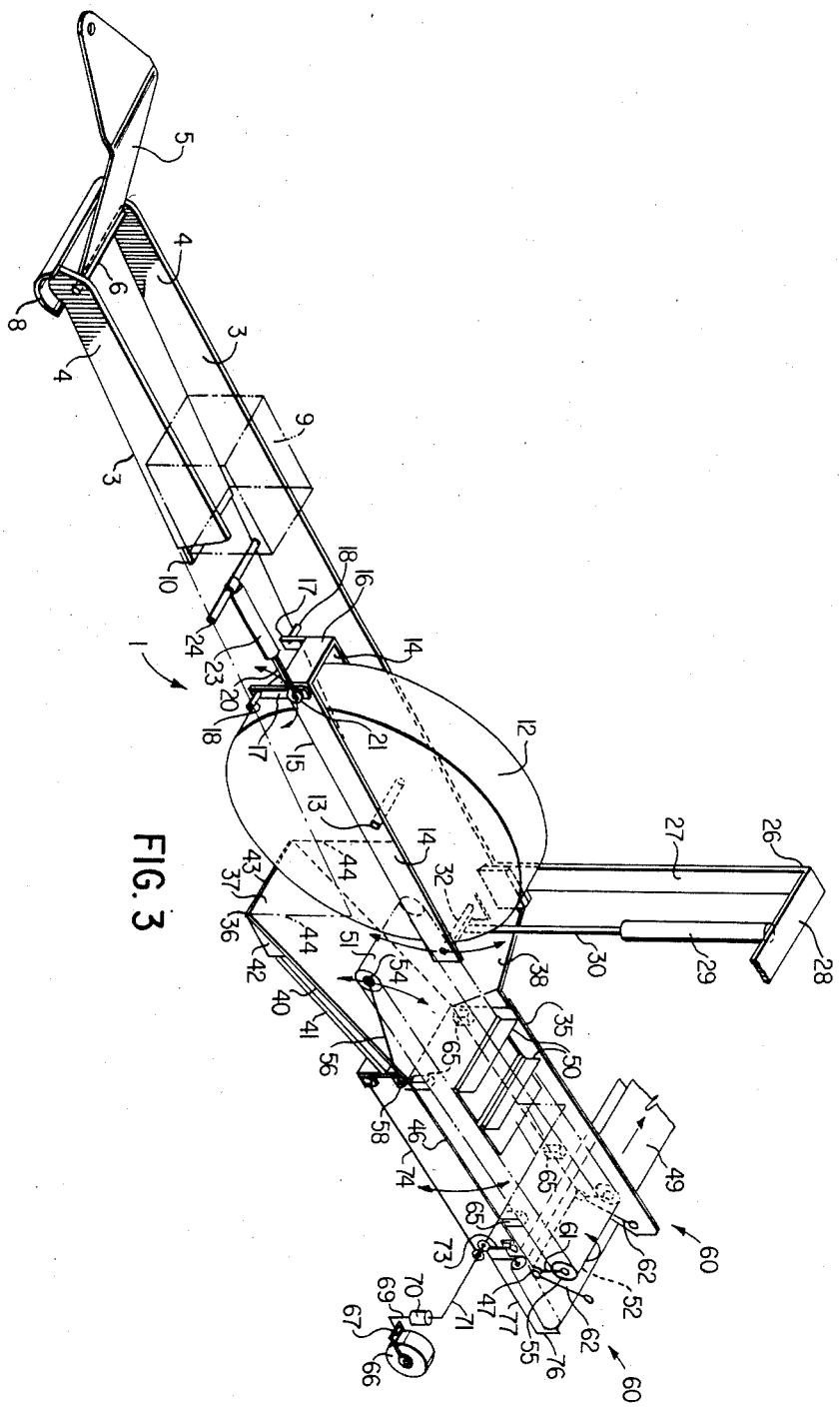
FIG. 3 is a partly sectioned, perspective view of the excavator of FIGS. 1 and 2.

Referring to FIGS. 1 to 3, the excavator of the present invention generally indicated at 1 includes an elongated, generally rectangular (in plan) frame 2 defined by a pair of sides 3 interconnected at various points along their lengths as described herinafter. The front ends 4 of the sides 3 taper forwardly. A tow bar 5 defined by a generally triangular sheet is pivotally connected to the sides 3 by a shaft 6 for connecting the excavator to a towing vehicle 7. A semicylindrical foot or slide 8 is provided on the front end 4 of the sides 3 beneath the rear end of the two bar 5. The hydraulic drive (not shown) for the excavator is housed in a casing 9 mounted on a plate 10 extending between the sides 3 rearwardly of the front ends 4 thereof.

The bulk of the frame 2 is carried by a large, centrally located wheel 12. The wheel 12 is mounted on a shaft 13 extending between the sides 14 of a rectangular support frame 15. The front end 16 of the frame 15 is supported by a pair of vertical arms 17. The bottom ends of which are pivotally connected to the sides 3 by short shafts 18. The outer end of a piston rod 20 is pivotally connected to the top ends of the arms 17 by pins 21 (one shown). The piston rod 21 extends into one end of a hydraulic cylinder 23, the other end of which is pivotally connected to a shaft 24 extending between the sides 3 of the frame 2 in front of the wheel 12.

Thus, by extending or retracting the piston rod 20, the support frame 15 can be moved horizontally and vertically relative to the frame 3. For such purpose, the rear end of the frame 15 is supported by an inverted U-shaped frame 26. The vertical arms 27 (one shown) of the frame 26 are pivotally connected to the sides 3 of the frame 2. While the frame 26 can be locked in the vertical position, it is also possible to rotate the frame 26 relative to the frame 2 to the horizontal, storage or transport position. One end of a hydraulic cylinder 29 is pivotally connected to the horizontal arms 28 of the frame 26. A piston rod 30 extends downwardly from the other end of the cylinder 29 to a shaft 32. The piston rod 30 is pivotally connected to the shaft 32, which extends between the sides 14 of the wheel support frame 15. The cylinder 29 is used in conjunction with the cylinder 23 to vary the vertical position of the support frame and consequently of the frame 2 relative to the ground level 34.

The rear end 35 of the frame 2 supports an inclined chute 36 defined by a base or blade 37 and sides 38 (one shown—FIG. 3). The blade 37 is defined by inclined top and bottom plates 40 and 41, respectively extending between the sides 3 of the rear of the frame 2, and reinforcing gussets 42 (one shown) at the leading end of the plates 40 and 41. The leading edge 43 of the blade 37 and the leading edges 44 of vertical portions of the sides 3 extending downwardly to the blade 37 define cutting edges for cutting into the soil as the excavator advances.

Material passing up the chute 36 is received by a rearwardly extending table 46, the trailing edge 47 of which curves downwardly for discharging soil to a transversely extending conveyor 49, which carries soil away from the excavator.

The soil is pushed along the table 46 by transverse paddles 50 on the belt 51 of an endless belt conveyor 52. The belt 51 passes around front and rear rollers 54 and 55, respectively.

The front end of the conveyor 52 is supported by a linkage defined by a pair of arms 56 (one shown). One end of each arm 56 is pivotally connected to the axle of the roller 54, and the other end of the arm 56 is pivotally connected to a shaft 58 extending between the bottom ends of the arms 56 on the sides of the chute 36. The rear end of the conveyor is supported by a pair of compound hinges, generally indicated at 60 (FIGS. 2 and 3).

Each hinge 60 includes a first arm 61, the ends of which are pivotally connected to the stub axle on one side of the roller 55 and to a short sleeve on one end of a shaft (not shown) extending between the sides of the frame 3. A second arm 62 extends between the shaft and pins (not shown) extending inwardly from the top rear ends of the frame sides. 3. Thus, both ends of the conveyor 52 can be raised or lowered to permit more or less soil to pass thereunder. Moreover, the conveyor can move longitudinally while rotating around the axis of the front and rear shafts. The minimum spacing between the bottom run of the conveyor 52 and the table 46 is set by posts 65 on the corners of the table 46.

The rear ends 35 of the frame 2 is stabilized by a pair of wheels 66 which are rotatably mounted in U-shaped brackets 67 on the bottom ends of L-shaped arms 69. The arm 69 on one side of the excavator extends into a hydraulic cylinder 70 for maintaining the frame 3 level (in transverse direction). The other arm 69 and the cylinder 70 are connected to a shaft 71.

The shaft 71 is connected to the frame 2 by an L-shaped linkage, the arms 73 and 74 of which are pivotally connected to the shaft 71 and to the sides 3 of the frame. The conveyor 49 is also connected to the frame 2 by a similar linkage including arms 76 and 77. Thus, as the rear end of the frame 2 is moved up and down, the conveyor 49 is kept level.

Figure 4:
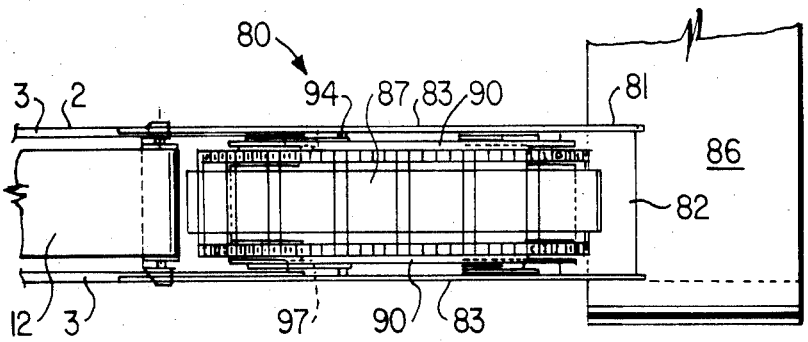
FIG. 4 is a plan view of a conveyor at the rear end of the excavator of FIGS. 1 to 3.
Figure 5:
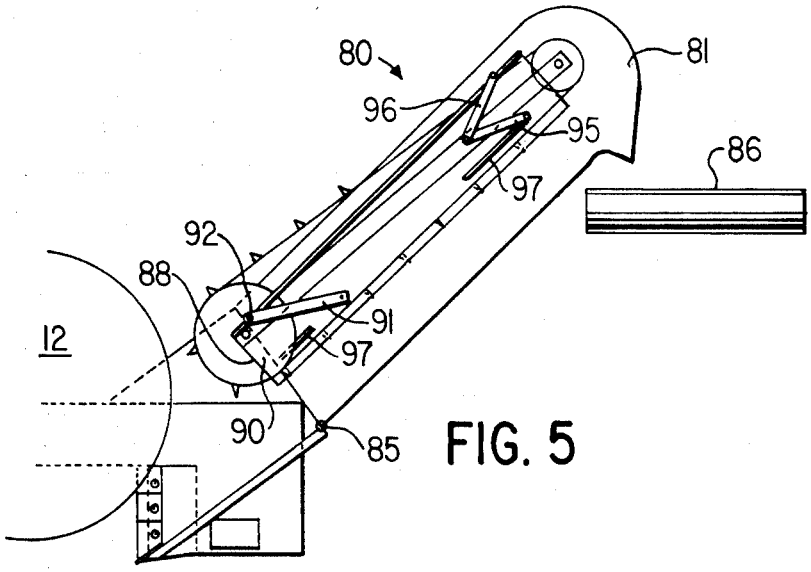
FIG. 5 is a side view of the conveyor of FIG. 4.

With reference to FIGS. 4 and 5, an alternate form of conveyor system generally indicated at 80 includes a conveyor chute 81 defined by a bottom wall 82 and side walls 83. The chute 81 is rotatably connected to the frame sides 3 by a hinge 85 for discharging soil to an elevated transverse conveyor 86. An endless belt conveyor 87 is mounted in a frame 88 in the chute 81. The frame 88 is defined by a pair of sides 90 which are connected to the side walls 83 of the chute 81 by front and rear hinges. Each front hinge is defined by an arm 91, the front end of which is pivotally connected to one side 90 of the frame 88 by a pin 92 and the rear end of which is pivotally connected to the adjacent side wall 83 of the chute 81 by a pin 94. Each of the rear hinges is defined by a pair of arms 95 and 96, which are pivotally connected at one end to each other. The other ends of the arms 95 and 96 are pivotally connected to the adjacent side wall 83 of the chute 81 and the adjacent side 90 of the frame 88, respectively. Stops 97 extend from the side walls 83 of the chute 81 into the path of the hinges for limiting downward movement of the conveyor 87 towards the bottom wall 82 of the chute 81. Soil passes beneath the conveyor 87, and is fed upwardly and dropped onto the conveyor 86. The conveyor 87 is free to float on the soil, while transversely extending paddles or blades 98 push the soil upwardly and rearwardly.

Figure 6:
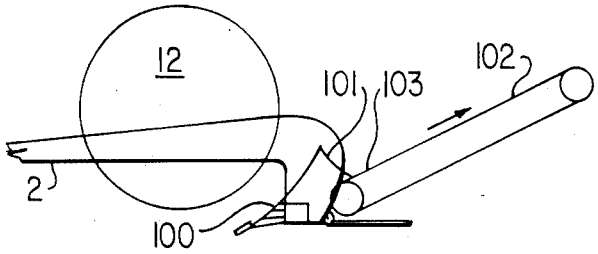
FIGS. 6 and 7 are schematic, longitudinal sectional views of the rear end of an alternate form of conveyor system for use with the excavator.

Referring to FIG. 6 in another embodiment of the invention, the blade 37 is replaced with a blade 100, which is inclined upwardly to an elevated, inclined trailing end 101 above a conveyor 102. The leading end 103 of the conveyor 102 is located beneath the trailing end 101 of the blade 100, so that the soil being excavated is accelerated onto the conveyor 102 by falling down the trailing end 101 of the blade onto the conveyor. The conveyor system of Fig. 7 is identical to that of FIG. 6, the only difference being that the trailing end 104 of the blade 100 is more or less flush with the leading end 103 of the conveyor 102, so that the soil is not accelerated onto the conveyor 102.

Figure 7:
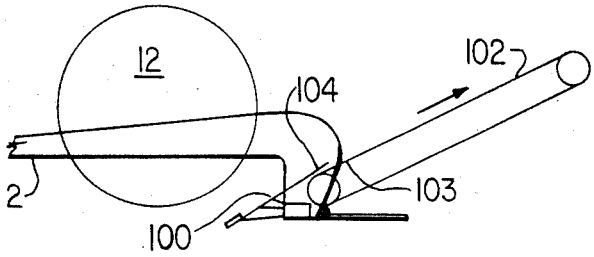
Figure 8:
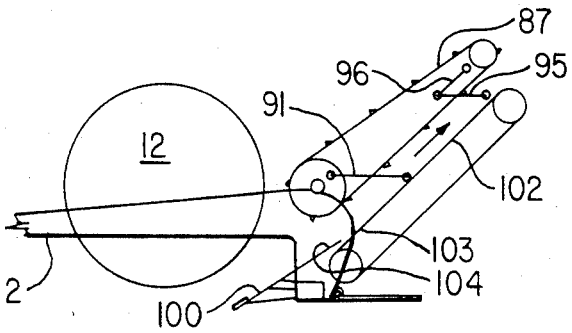
FIG. 8 is a schematic, longitudinal sectional view of the rear end of another alternate form of conveyor system for use with the excavator of FIGS. 1 to 3.

The conveyor system of FIG. 8 includes the top conveyor 87 of FIGS. 4 and 5, and the bottom conveyor 102 and blade arrangement of FIG. 7.

In use, the hydraulic cylinders 23 and 29 are used to adjust the depth of cut of the blade 36. The frame 2 is maintained level in a transverse direction by the cylinder 70. It will be appreciated that when not in use, the entire excavator can be loaded onto a large flatbed truck or trailer for transport to another location.

What I claim is:

1. A soil excavator comprising elongated first frame means, said first frame means including a pair of spaced apart sides; tow bar means at the front end of said first frame means for connecting the excavator to a towing vehicle; inclined blade means mounted between said sides in close proximity to the rear end of the first frame means for penetrating the ground and directing soil upwardly and rearwardly; conveyor means rearwardly of said blade means for discharging excavated soil from the excavator; wheel means rotatably mounted between said sides above said blade means for carrying the first frame means; and support means carrying said wheel means pivotally mounted in said first frame means, whereby the wheel means can be moved longitudinally and vertically in said first frame means for adjusting the depth of cut by said blade means.

2. A soil excavator according to claim 1, wherein said sides of frame means are parallel and extend from said tow bar means to the rear, discharge end of said conveyor means.

3. A soil excavator according to claim 1, including substantially horizontal table means rearwardly of said blade means for receiving soil therefrom and beneath said conveyor means, whereby, said conveyor means can engage the soil from above for rearward discharge from the excavator.

4. A soil excavator according to claim 1, wherein said support means for said wheel means includes second frame means in said first frame means; fluid actuated first cylinder means carrying one end of said second frame means for rotating said one end through a vertical arc; and pivot means supporting the other end of said second frame means for rotating said other end through a horizontal arc.

5. A soil excavator according to claim 4, wherein said pivot means includes vertical arm means fixedly connected at one end to said other end of said second frame means, the other end of said arm means being pivotally connected to said first frame means; and fluid actuated second cylinder means for rotating said arm means and said other end of said second frame means around the horizontal axis.

6. A soil excavator according to claim 3, including linkage means pivotally mounting the ends of said conveyor means in said first frame means, whereby the conveyor means is free to move vertically on the excavated soil on said table means.

7. A soil excavator according to claim 6, including spacer means for maintaining a predetermined minimum spacing between said conveyor means and said table means.

8. A soil excavator according to claim 1, including stabilizer wheels for supporting the rear end of said frame means.

9. A soil excavator according to claim 8, wherein at least one of said stabilizer wheels is vertically adjustable.

10. A soil excavator according to claim 1, wherein said conveyor means includes a third frame means movably mounted in said first frame means for limited vertical and horizontal movement relative to the excavated soil.

11. A soil excavator according to claim 10, wherein said conveyor means includes a first conveyor in said third frame means for movement therewith, and second conveyor in said first frame means beneath said first conveyor for receiving soil excavated by said blade means.

12. A soil excavator according to claim 1, wherein said conveyor means is located in said first frame means rearwardly and beneath the rear end of said blade means, whereby soil is accelerated onto said conveyor means from the blade means.

13. A soil excavator according to claim 1, wherein said conveyor means is located in said first frame means rearwardly and substantially flush with the rear end of said blade means for receiving soil therefrom.

* * * * *